United States Patent [19]

Kilb et al.

[11] Patent Number: 4,499,690

[45] Date of Patent: Feb. 19, 1985

[54] SPLIT STATIONS SURFACE GRINDING APPARATUS

[75] Inventors: Donald A. Kilb, Brookfield; Richard A. Diercksmeier, Milwaukee, both of Wis.

[73] Assignee: E. D. Coddington Manufacturing Company, Milwaukee, Wis.

[21] Appl. No.: 474,021

[22] Filed: Mar. 10, 1983

[51] Int. Cl.[3] ..... B24B 7/02

[52] U.S. Cl. ..... 51/56 R; 51/165.71; 51/165.87

[58] Field of Search ..... 51/54, 56 R, 122, 216 R, 51/216 A, 165.7 P, 165.71, 165.86, 165.87

[56] References Cited

U.S. PATENT DOCUMENTS

| | | | |
|---|---|---|---|
| 1,634,386 | 7/1927 | Schramm | 51/165.86 |
| 2,917,874 | 12/1959 | Lierse | 51/122 |
| 3,751,855 | 8/1973 | Pinat | 51/56 |
| 4,262,454 | 4/1981 | Iida | 51/165.71 |

FOREIGN PATENT DOCUMENTS

| | | | |
|---|---|---|---|
| 2742004 | 3/1979 | Fed. Rep. of Germany | 51/54 |

*Primary Examiner*—Harold D. Whitehead
*Attorney, Agent, or Firm*—Andrus, Sceales, Starke & Sawall

[57] ABSTRACT

A dual split station production grinding machine includes first and second elongated electromagnetic chucks or other suitable work holders located to the opposite sides of a central grinding head location and defining separate work stations. A computer programmable control permits user programming for particular reciprocating movement of the grinding apparatus over each chuck for grinding. Sensor units are located at the opposite limit positions of the wheel for each station and provide input signals to the processor for controlling the traversing movement of the grinding head. An interlock means includes manual cycle starter controls permit enabling the machine to automatically cycle back and forth between the operating stations. The program for each work holder is separately created with the total vertical movement of the grinding wheel as well as incremental movement during successive passes, and the number of final spark-out passes. A wear compensation factor is incorporated in the program to position the wheel and compensate for wheel wear to grind the surface to a highly accurate final dimension. The start positions for the two work holders are spaced slightly from each other. The head moves to the alternate start position for the other work holder for unloading and reloading parts during the grinding of parts over the other work holder. The program includes different stop controls which permit interruption of the grinding cycle. The program may permit restarting from the same program point or require recycling.

15 Claims, 6 Drawing Figures

SPLIT STATIONS SURFACE GRINDING APPARATUS

BACKGROUND OF THE PRESENT INVENTION

This invention relates to an automatic grinding machine and particularly to a production surface grinder for grinding of flat or contoured surfaces on parts.

In the forming of various metal, metal parts are formed which must have a finished and accurately ground surface. Various grinding machines are available, in many of which the part is moved past a grinding wheel or the like. A particularly satisfactory production surface grinding machine for forming of flat or contoured metal parts and the like is manufactured and sold by REFORM Maschinenfabrik A. Rabenseifner and Co. of West Germany. The production surface grinder has a long supporting bed which may have a length of hundreds of inches, such as 30 to 500 inches. The bed is provided with a stationary electromagnetic chuck. The metallic work part is fixedly secured to the chuck by energizing of electromagnets in the chuck. A grinding unit is mounted on a traversing carriage which is adapted to move over the complete length of the bed. A suitable hydraulic motor is connected to the carriage which reciprocates back and forth over the magnetic bed. A drive motor and spindle is secured to the carriage and an annular grinding head is secured to the spindle and supports an annular grinding wheel. Energization of the head motor results in corresponding rotation of the spindle with the end face of the annular grinding wheel moving over the surface of the work part and grinding of the top surface. The grinding wheel is moved downwardly a small step at the end of each pass until the total amount is reached. Such machines are known and used in industry where high quality production grinding of metal parts or pieces are required. Such machinery of course is expensive and maximum usage of the apparatus is required.

Grinding apparatus of such construction generally require the manual operation when relatively small parts are being worked in order to control the work cycle. Significant production time is lost during the time of loading and unloading the machine during which grinding cannot be carried out.

There is a need for production grinding apparatus which permits continuous grinding operation during the periods of loading and unloading of parts and the like.

SUMMARY OF THE PRESENT INVENTION

The present invention is particularly directed to a dual split station production grinding apparatus having a programmable control for continuous cyclic grinding operation by alternate operation of the stations. Generally, in accordance with the present invention, the grinding apparatus includes a multiple elongated work holder constructed as a multiple station assembly and having separate holder sections to the opposite sides of an intermediate head start or "home" location, in combination with means for actuating a grinding head unit from such intermediate station to move in cyclical sequence over the separate holder sections to the opposite sides thereof, with independent control for each station. The apparatus of this invention further may include a mode of operation in which the grinding head unit is operable to traverse the complete holder means and thereby provide grinding over the complete length of the machine. More particularly, the grinding apparatus is provided with separate head positioning control operable to the first and second sides of the intermediate home or start location. The machine is thus operable to grind parts on one holder while parts are being processed such as unloaded and reloaded on the opposite holder. An interlock means is provided to permit the presetting of the machine to automatically cycle back and forth from an operating station to the opposite station, such that the grinding apparatus proceeds in a continuous manner. The programmed control for each operating station can of course be uniquely adapted to a particular grinding operation such that the same or significantly different parts can be processed. In accordance with a particularly unique embodiment of this invention the machine is provided with an appropriate computer-type programmable control which permits user programming of the particular movement of the grinding apparatus at each station. Sensors provide the input signals to the processor for controlling the positioning and movement of the grnding head and wheel. Generally, the control includes the total vertical positioning of the grinding wheel, the incremental movement during successive passes, and the number of the final spark passes. Further, compensating factors such as grinding head wear compensation are incorporated into the programmable grinding cycle. Thus, the continued operation of the grinding head over a period of time results in wearing of the grinding head. The machine is programmed to automatically compensate for such factor and provide appropriate movement of the grinding head to produce the desired grinding of the surface to a highly accurate final dimension. In addition, other necessary processing such as final finishing and the like is programmed into the apparatus controller.

In accordance with a particularly practical implementation of the present invention, the grinding head was programmed to operate to the opposite sides from a central home location, with the starting position for each grinding section initiated from a start position adjacent to the corresponding end of the home station, and spaced slightly from each other. Horizontal position sensor means provide signals of the head movement to each limit position. A signal generator is coupled to the vertical head positioning drive and produces a position related signal. A programmed controller responds to the position signals from the sensors and the generator to properly move and reposition the head during a grinding cycle. After finishing a grinding operation, the head moves to the alternate initial starting position. In this position, the parts can be unloaded and reloaded on the just completed side. After moving to the opposite or next starting position, the grinding wheel is repositioned for the new grinding cycle and then proceeds to operate to complete the grinding operation on the opposite station. The reciprocating grinding movement is conveniently controlled by any suitable sensors, such as cam operated switches located at the respective limit positions for each grinding station or section. The end sensors provide inputs for operating the machine as single long bed.

The present invention thus provides a versatile multiple station grinding apparatus having a grinding head reciprocating over a plurality of work stations or sections as a single elongated operating station, or moving alternately over several individual end-to-end stations in an alternating sequence.

In a preferred embodiment, the program is constructed to include a special stop cycle which permits interruption of the grinding cycle. The program can be restarted from the same program point by repositioning the carriage to the normal starting position and reinitiating the program cycle. A further control permits the momentary interruption with the carriage moving to the end of its traversing position limit. A subsequent actuation of this control causes the machine to proceed and complete the programmed grinding. An emergency control is provided which removes all power. The program cannot then be reinitiated but rather the part must be normally manually completed.

The present invention thus provides a reliable and versatile grinding apparatus having multiple modes of operation including multiple programmed modes of operation.

DESCRIPTION OF THE DRAWING FIGURES

The drawings furnished herewith illustrate a preferred construction of the present invention in which the above advantages and features are clearly disclosed as well as other which will be readily understood from the following description.

DESCRIPTION OF THE ILLUSTRATED EMBODIMENT

Figure 1:
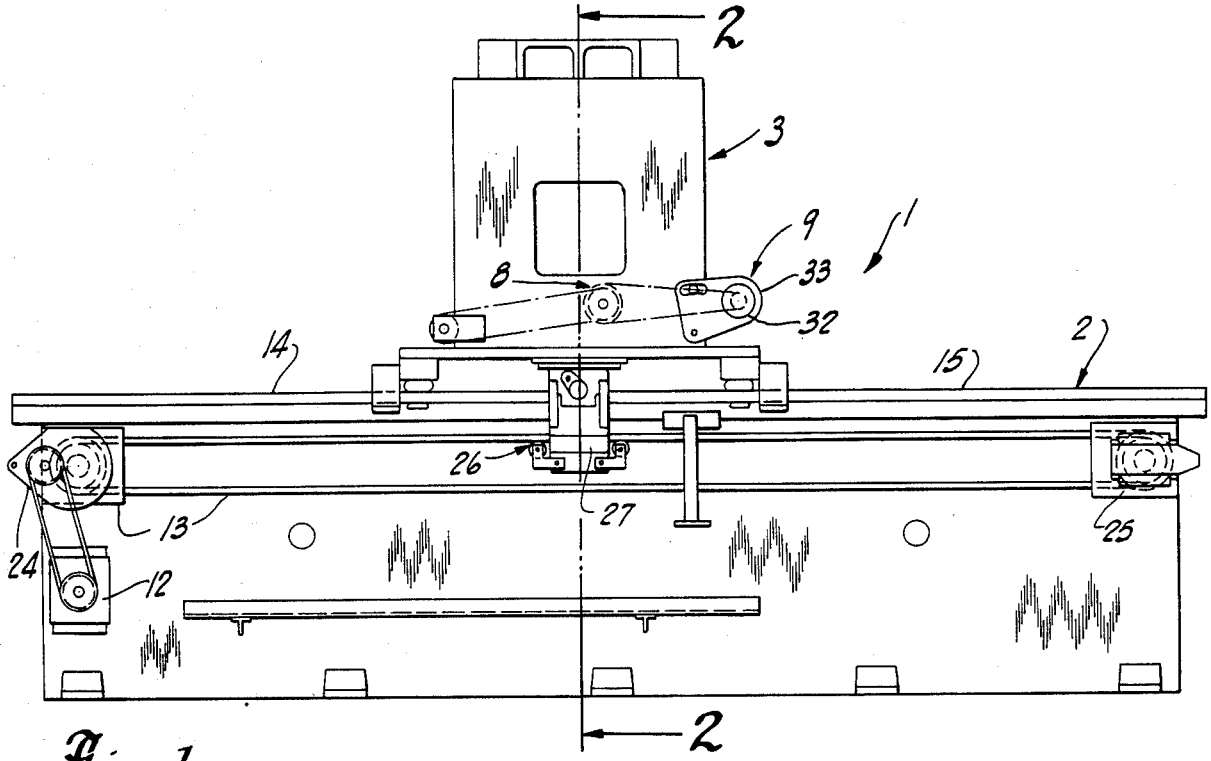
FIG. 1 is a front elevational view of a grinding apparatus constructed in accordance with the teaching of the present invention.
Figure 2:
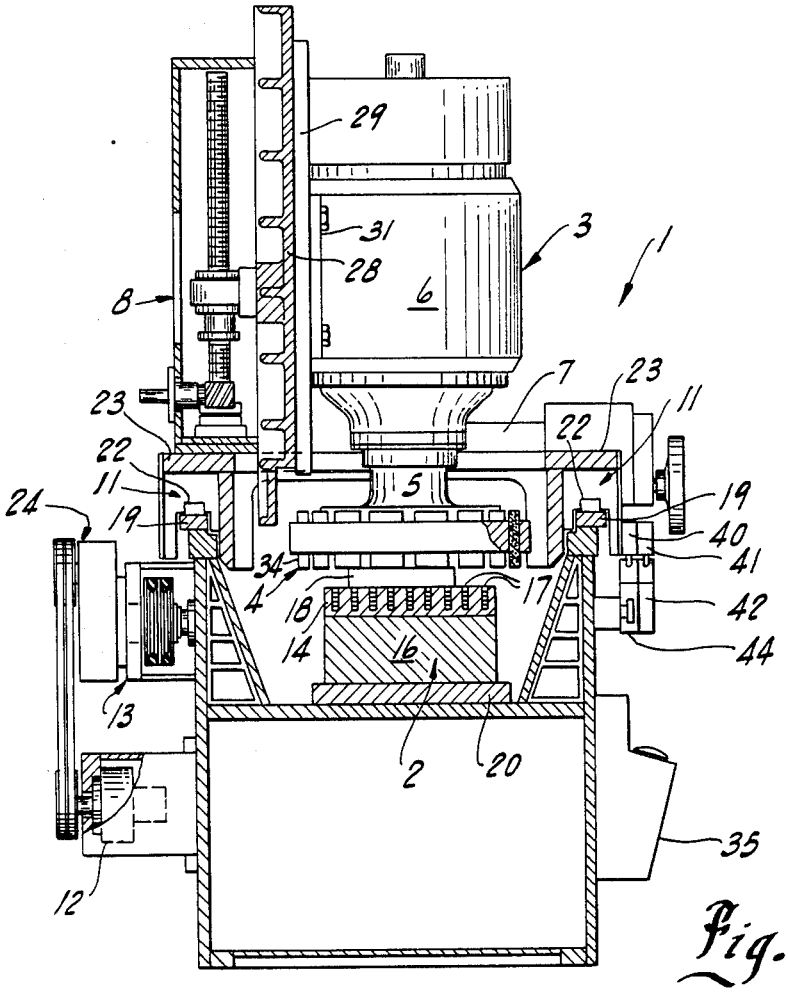
FIG. 2 is an end view with parts broken away and sectioned to show details of construction.
Figure 1A:
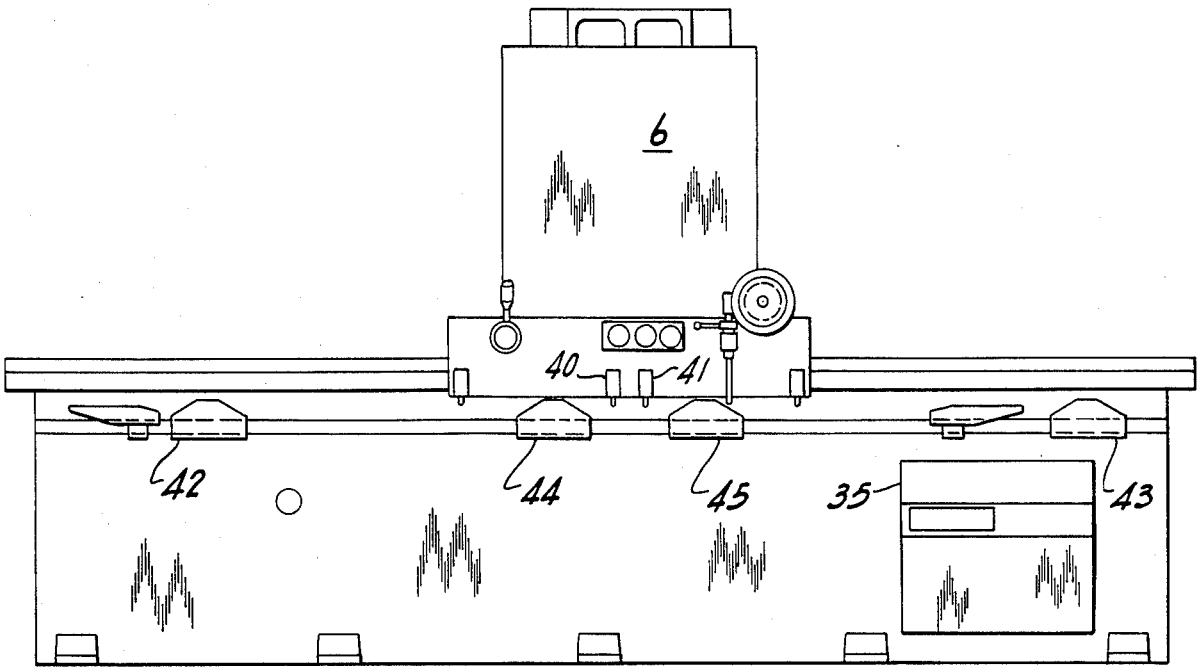
FIG. 1A is a rear elevation.
Figure 3:
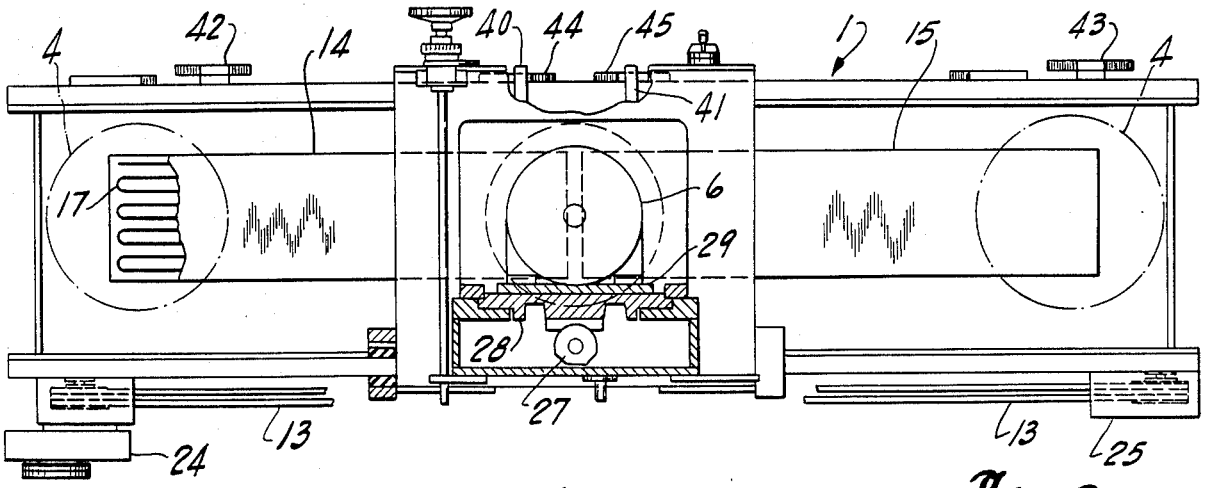
FIG. 3 is a plan view of the apparatus shown in FIGS. 1 and 2.

Referring to the drawings and particularly to FIGS. 1 and 2, a fixed bed grinding apparatus 1 is illustrated. Generally, the apparatus 1 includes an elongated bed structure 2 with a grinding head assembly 3 mounted for longitudinal movement over the bed structure 2. The grinding head assembly 3 includes a grinding head or wheel 4 secured to a motor-driven spindle 5. A drive motor 6 has the spindle 5 secured to its shaft and is adjustably mounted to a carriage 7 through an adjustable ball screw feed means 8. A vertical positioning motor 9 is coupled to the feed means 8 for positioning the grinding head 4 with respect to the bed structure 2. The carriage 7 is mounted by suitable hardened and ground guides 11 on the bed structure 2. A hydraulic motor 12 is belt-coupled to a gear reduction and elongated endless belt unit 13 for horizontal movement of the carriage and head assembly 3 over the bed structure 2.

In accordance with the present invention, the bed structure 2 includes first and second similar stationary electro-magnetic chuck members 14 and 15 secured centrally of the bed and in transverse alignment. Each chuck member 14 and 15 is similarly constructed as an elongated flat bed unit 16 within which electromagnets 17 are embedded. Energization of the electromagnets 17 create a magnetic flux in the bed unit 16 to firmly lock metal work parts 18 thereon for grinding of the upper surfaces. The chucks 14 and 15 are adapted to be separately energized from a suitable power supply, which may include a full voltage or alternatively a variable voltage. The hydraulic system only operates for carriage movement if the magnetic chuck is properly energized. The head assembly 3 is selectively movable from a central or intermediate location adjacent the common chuck ends as the "home" location, in opposite directed grinding cycles. Thus, the head assembly 3 separately reciprocates over the separate electromagnetic chucks 14 and 15 under a programmed control for continuous grinding of parts 18 supported on the respective chucks 14 and 15, or alternatively movable over the chucks 14 and 15 as a single unit under manual or semi-automatic control.

Referring particularly to FIG. 2, the bed structure 2 includes a pair of laterally spaced hardened rails 19 which are secured to a heavy rigid framework defining a support adapted to receive a relatively heavy operating and working loads. The rails 19 are located upwardly of a work area which includes a heavy base plate 20 on which the elongated chuck means 14–15 are fixedly secured.

Figure 5:
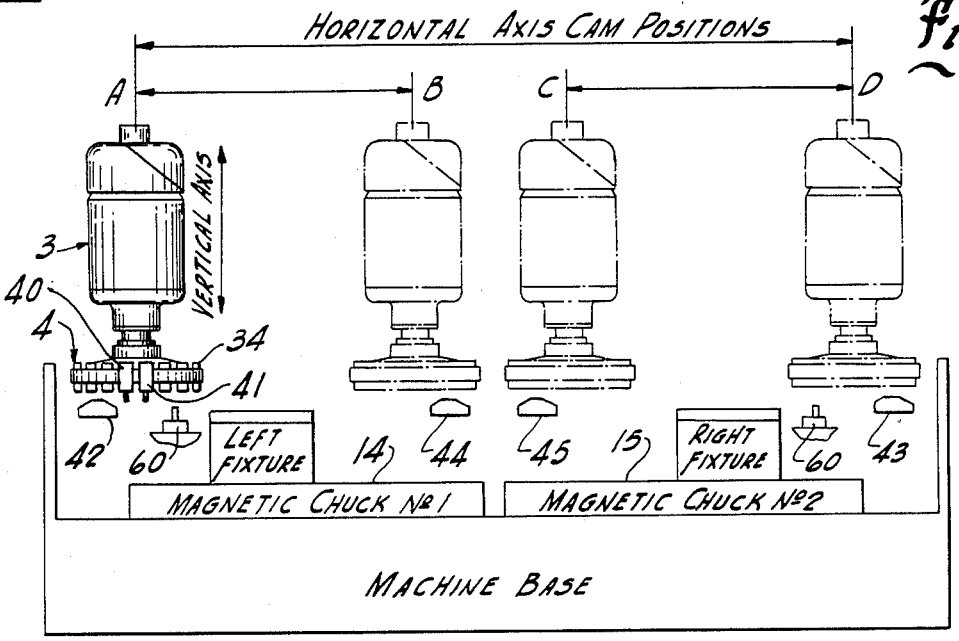
FIG. 5 is a simplified illustration of a machine shown in FIGS. 1 and 2 to illustrate the machine operation.

The illustrated chuck means 14–15 are known electromagnetic units, such as used in the Reform machine and have smooth top surface. The chuck is formed of a magnetic material and the electromagnetic coils 17 are located within the bed and when energized define large magnetic holding forces for steel parts. The holding forces are such that high grinding forces can be impressed on the upper surfaces of the work parts. The chucks may of course be replaced with any suitable work holder, and in discussing the function of work holding the work or part, a fixture may in fact be physically connected to the part and held in place by the appropriate work holder, as shown in FIG. 5.

The work parts 18 are shown as simple block members, the upper faces of which are to be removed by grinding to a smooth final finish.

In the illustrated embodiment of the invention, the grinding head assembly 3 includes a carriage 7 having guideways 22 moving on the rails 19 for longitudinally moving along the bed and particularly over the electromagnetic chucks 14 and 15.

The carriage 7 consists of a substantially rectangular frame 23 spanning the rails and having guideways 22 secured to the four corners thereof. The carriage 7 is belt-driven from the high power hydraulic motor 12 secured to the one end of the bed. A gear reducer and input drive pulley unit 24 is provided at one end of the bed. Idler pulleys 25 are secured to the opposite end of the bed, and endless drive belts 13 are looped about the opposite pulleys. A depending clamp bracket 26 is secured to the carriage and depends downwardly therefrom. The belts 13 are clamped by a suitable pressure locking means 27 within recesses in clamp bracket 26, such that the rotation of the belts 13 results in a corresponding movement of the carriage 7 for traversing of the bed.

A heavy motor plate 28 has the opposite edges mounted in vertical slotted guide members 29 rigidly affixed to the frame 23. The spindle motor 6 is secured to the vertical positioning plate 28 as by brackets 31 integrally formed with the motor casing. The spindle 5 is secured to the lower end of the motor shaft. A ball and screw drive unit 8 is secured to the back side of the machine and forms an integrated part of the carriage. The motor plate 28 is secured to the ball and screw drive unit 8.

An electric servo motor 32 is secured to the frame and connected to actuate the feed screw unit 8 for vertical positioning of the wheel 4. A signal generator such as a known resolver 33 is coupled to the feed screw drive 8 and generates an output signal which is position sensitive. Thus, the resolver 33 is typically connected directly to the servo motor 32 and provides an electrical signal which is proportional to the position of the feed screw unit 8 and therefore of the grinding head spindle 5 and wheel 4 relative to the chucks 14 and 15.

The spindle 5 includes a mounting plate. The annular wheel 4 is bolted to the plate and includes means to receive a plurality of grinding tool segments 34 which conjointly define the substantially continuously annular grinding wheel. The lower end of the several segments 34 are located in a common plane to define a flat grinding surface. Thus, the grinding wheel 4 may include a continuous, annular grinding tool element. Although not generally used, the tool element could even be a flat continuous disc member. The term annular tool element is used herein to generally define such grinding tool which provides a lower grinding face for grinding an upwardly exposed surface of a work part. Further, although shown with a horizontally located grinding face for grinding of flat horizontal surfaces, grinding machines of this type are also adapted to contour grinding by the use of auxiliary grinding heads. Of course, means may be provided to orient the head for grinding at some angle for contour grinding.

In accordance with the present invention, the machine includes the separate multiple work holders 14 and 15 as well as various interrelated controls whereby individual and separate work stations are defined to the opposite sides of the center of the bed. The individual chucks 14 and 15 however are located in close spaced or butting relation so as to permit functioning as a single chuck assembly for purposes of providing the alternate mode of operation of the machine.

The machine is thus constructed to operate under the three different modes including a manual mode, an automated mode and, in accordance with this invention, a unique programmed mode. In the programmed mode the head assembly 3 is automatically and alternately reciprocated over the two chucks 14 and 15 from the central "home" position.

The illustrated machine includes a control console or panel 35 having standard control elements, not shown, for the manual and semi-automatic modes, and additional program controls 37 adapted to the split station operation under a continuous programmed mode of operation. The control panel 35 particularly includes a programming section 38, which may be of the touch button type, for user programming of the machine to operate over the chuck 14 or the chuck 15.

A selection switch unit 39 provides for interconnection of the system under the dual or split programmed control, under the normal manual mode or the automatic but noncontinuous mode of operation. The control and operation of the operating components including the drive motors, the chucks and the like during a programmed mode is controlled by a suitable programmable controller such as a microprocessor. A program mode enabling switch button 39*a* provides for enabling the machine for operation in the programmed mode.

The position of the head assembly 3 between the several possible starting and ending locations on the bed structure 2 is monitored by a plurality of position sensor units. In the illustrated embodiment, actuated switch units are shown for the respective sensors. Thus, in the illustrated embodiment, a pair of limit switches 40 and 41 are mounted on the carriage 7 and four switch cams 42, 43, 44 and 45 are secured to the machine bed. The limit switches 40 and 41 in combination with cams 42–45 provide the basic inputs to the controller for determining the sequence of operation of the head assembly. The first sensor cam 42 is located on the bed structure 2 to a first end of the bed, shown as the left end in FIGS. 1 and 4, the second similar sensor cam 43 is secured to the opposite or right end of the bed. The third and fourth sensor cams 44 and 45 are located in slightly spaced relation adjacent the intermediate home position of the head assembly 3 on the bed structure 2 and define the head start positions for the left chuck 14 and for the right chuck 15, respectively.

The programmed mode and operation include automatic vertical positioning of the grinding head assembly 3 in the initial start position, and with the head assembly 3 at either the left or right intermediate start position. The program in addition provides for initiation of the operating cycle to either the left or the right side of the bed 2 in response to actuation of the corresponding left or right cycle start button 46 and 47, and storage of such actuation in memory. Upon execution of the program in response to the programmed start signal, the machine moves the head assembly 3 to the appropriate start position as set by the limit sensor cams 44 or 45. The head assembly 3 reciprocates over the corresponding chuck 14 or 15, and the grinding wheel 4 rotates to grind the surface of the part 18, as the grinding wheel traverses over the part. The head assembly 3 continues to reciprocate between the limit positions determined by the setting of the limit sensor switch 40 or 41, and the interrelated cams 42–44 or 43–45, over the part 18 with automatic incremental downfeeding of the grinding head assembly 3 and particularly the tool at each end of horizontal traverse until the final preset position is reached. As the program approaches the final downfeed position, an automatic tool wear compensation factor is programmed and added into the downfeed program to continue the downfeed positioning of the head assembly 3 and thereby compensate for wear of the grinding tools until the proper part height is reached. In the final pass, the grinding wheel 4 is automatically set at the proper final increment to precisely establish the proper part heighth. Finally, after the part 18 has been ground to the desired surface position, the head assembly 3 is automatically actuated for a predetermined number of "spark-out" passes over the ground surface to finish the surface, after which the grinding head assembly 3 is retracted and then moved to the home position. Thus, if the head assembly 3 stops at an outer end, the return to the home position does not create another grinding pass over the part 18. In moving to the home position, the head assembly 3 is repositioned to the alternate chuck start position.

For example, if a left chuck cycle has been executed and if the opposite or right cycle control has been actuated, the program is executed with automatic repositioning of the head assembly to the start position, moving the head to the proper vertical heighth and a similar programmed sequence including the reciprocation of the head over the right chuck 15 for corresponding grinding of the parts, including automatic wear compensation during the final grinding and prior to the final spark-out passes. During such alternate working cycle, the operator can of course be unloading and reloading the left chuck member 14.

The programming section 38 of the panel 35 includes a numeric key section 48 and a functioning select section 49 for the introduction of the separate programs for the left and right chucks 14 and 15. A run/enter selection switch unit 48*a* is provided to condition the microprocessor for receiving of the program, or for outputting of the program for programmed operation of the chucks 14 and 15 and the movement of the grinding head assembly 3. This section 38 is shown with input keys for the left and right programs, with a right/left selection switch unit 48*b* for independent programming of the left and right grinding cycles. Switch 48*b* is only functioning with switch 48*a* in the "Enter" position. The individual left and right cycle start buttons 46 and 47 are provided on the machine controller for enabling the corresponding left and right programs. The button 46 and 47 operate only in the programmed dual or split chuck mode and provide for continuous alternate programmed operation of the head assembly 3.

In addition, cycle cancel buttons 50 and 50*a* are provided for the left and right programmed cycle. When actuated during the operation of the corresponding cycle, the cancel buttons 50 and 50*a* function to terminate execution of the corresponding programmed grinding cycle. The head assembly 3 is held in the last vertical position and cycle can be restarted at the same point in the program to complete the programmed sequence from the termination point. The carriage however must be returned to the normal start position for the corresponding left or right cycle prior to its restarting and the cycle start button for the corresponding side again actuated.

A power control button 51 is also operable during the programmed mode. Operation of button 51 results in the grinder completing the initiated pass and stopping when it reaches the left or right end of its travel. Actuating of the same button 51 a second time again initiates the cycle with the grinding cycle then continuing to the end of the program.

An emergency stop button 51*a* is also provided to remove all power from the machine and thereby instantaneously terminate the machine movement. The program does not provide for initiating the machine to complete a partially executed cycle. Thus, the part must be manually completed.

A digital readout means 52 is provided to continuously monitor and provide a visual indication of the relative vertical position of the spindle.

Various other control buttons are provided as a part of the normal controls 31 for operating of the system in the semi-automatic or manually automatic mode or the manual mode. Thus, a left/right traverse button may be provided for example to permit the actuation of the carriage in a corresponding continuous direction or to initiate the start of the movement after which the carriage will oscillate between its limit positions. If in the manual mode, the operation continues till a stop button is actuated. If in the automatic mode, the operation continues until the passes reach a preset number inserted in a counter. Means are also provided for moving the spindle and motor up and down at different speeds and even incrementally.

Digital readout means 52 must be set in either the manual or automatic mode with a predetermined movement number before the machine will start.

Figure 4:
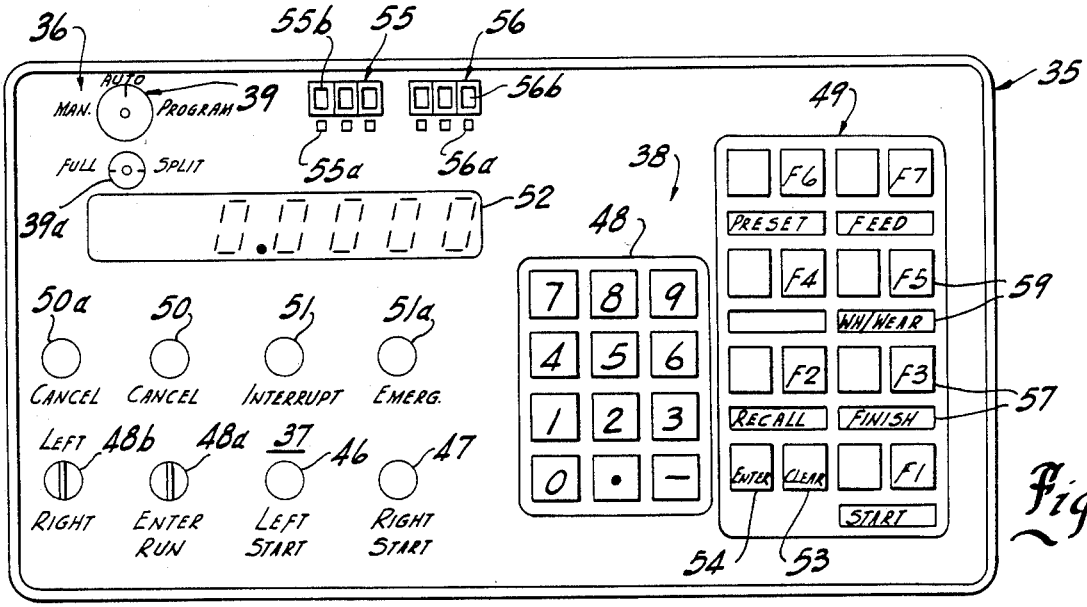
FIG. 4 is a view of an operation control panel including certain operator control and indicating means.

The left and right program functions are stored in a programmable memory, not shown, located within the controller. The programs are entered through the use of a conventional computer input means provided on the control panel keyboard 38 including the various numeric and function control keys, such as shown in FIG. 4. The input section has in addition to the function keys 49 and numeric keys 48, a clear key 53 and an entry key 54. The program is entered only by actuating one or more numeric keys 48 and a function key 49 and then the enter key 54 so that error during any one entry may be corrected by operation of the clear key 53 and the particular information reprogrammed.

The control further includes a left chuck "spark-out" counter 55 and a similar right chuck "spark-out" counter 56. The counters are preset by separate inputs 55*a* and 56*a* and include a visual display 55*b* and 56*b* with the number of final "spark-out" passes. The counters 55 and 56 are read during the execution of the respective left or right programs and establish the means for controlling the number of finishing passes of the wheel, occurring after the wheel reaches the preset vertical position. The left counter 55 operates in both the program mode and the automatic mode, while the right counter 56 operates only in the program mode.

The operator introduces all necessary movement information into the program, including the proper location of the tool surface with respect to the magnetic chucks 14–15. This may be done initially automatically or therough a manual gauging of the tool surface by application of a gauge to the chuck and manual positioning of the wheel into engagement with the gauge. The operator also introduces the initial or starting heighth position of the grinding wheel and particularly the grinding wheel surface at the initiation of the grinding cycle by actuation of the start function key 56 and actuation of the proper numeric keys 48. In addition, the operator introduces the final position of the wheel surface by actuation of the finish function key 57 and appropriate numeric keys 48 to thereby program the total downward movement of the wheel surface and the total amount of metal to be removed. The grinding is not done in a single pass over the part, and the operator programs the particular increments of tool movement for each pass by actuation of the feed key 58 and the numeric keys 48. In a practical application, for example, a maximum feed per index may be 0.025 inches. The execution of the program then proceeds to position the grinding head during each pass with the last positioning, if necessary being a partial increment to produce the proper heighth. Thus, the number of passes is determined by the programmed total to be removed and the programmed number of increments. Obviously, a similar program command can be created by programming the number of passes. The incremental removal is significant and is preferably programmed, such as in the illustrated embodiment. In grinding operations not only is material removed from part, but at least some of the grinding wheel is also removed. Generally, an operator knows essentially the amount of wear to be anticipated for any particular part and the particular grinding tool in use. The operator manually programs the wear compensation factor for that job cycle by opeation of the wear key 59 and the numeric keys 48. This may, for example, be on the order of one half inch per job cycle.

The compensation can also be automatically determined and programmed, such as by introducing of a sensing probe unit 60 such as a known LVDT sensing means to sense the relative programmed position of the grinding surface relative to its actual position during any desired pass in the total cycle. A separate probe unit 60 is of course provided for each chuck or work station. Wear would result in a variation from the programmed position and may produce a wear compensation signal, which can be introduced into the program using usual computer technology. Such a system would be particularly practical and useful where unknown wear rates are encountered.

Thus, the illustrated machine can be set in the normal modes to move the head assembly under manual or automatic operation with the head assembly then moving over the complete length of the bed, and over both of the left and right chucks or a single chuck. In such mode of operation, both chucks 14 and 15 are simultaneously energized and the head control is operated under a normal machine control which responds only to the end limit sensor cams 44 and 45.

A suitable program flow chart is submitted herewith for providing of the automated programmed control of the machine, and a program, shown in a ladder program diagram for a programmable controller sold by Allen Bradley Company of Milwaukee, Wis. under Model Mini PL-C programmable controller is submitted for filing herein. Referring particularly to the flow chart, the controller monitors the setting of the selector switch unit 39, to enter the program for operation of the grinding apparatus in one of the three modes. Prior to initiating a cycle a part, or parts 18, is secured to the magnetic chuck 14–15. The selector switch unit 39*a* is actuated to either operate as a split-bed machine or a single bed machine. In a single bed mode, the switch unit 39*a* results in turn-on of the magnets of both chucks 14–15 and further connects the normal operating mode controls, for either a manual or automatic selection. In the programmed split machine mode, the left and right chucks 14 and 15 are separately and alternatively energizable so as to define completely separate grinding machines having only a common head assembly 3. The logic controller monitors the setting of the programming switch 48*a* for either programming the machine or running the machine, as at 65. If in run, the operator program provides for part loading, after which the operator must actuate the chuck mode to operate as a single or split bed, as at 66. If a single bed is selected the controller executes the common bed mode, which is only the "manual" semiautomatic modes.

The "manual" and "auto" modes are shown in the separate flow chart B, and include essentially similar sequences with the head assembly 3 moved to the limit actuator 42, and again checks the mode to insure that the switch 39 is set to the manual or operating mode, as hereinafter described. Thus, assuming a split mode, the controller energizes one chuck, shown as the left chuck and then proceeds to start the several operating components and properly position to the head assembly 3, as at 67. The controller determines which of the operating modes has been set in switch 39.

If the chuck switch 39*a* has been set at single bed, the switch must be in either "manual" or "auto" setting as shown in chart B as at 68. In either position essentially the same sequence is created. However, in the manual mode the operator manually resets the increments and must initiate each pass of the grinding head. In either mode, the controller moves the head assembly to move between actuator 42 to actuators 43. In the auto mode, the controller also executes the spark-out pass as set in the one counter 55, as presently discussed with respect to the split mode.

If switch 39*a* has been set to split mode and the switch 39 set to either the "manual" or "auto" mode the controller cycles to the appropriate program, such as in accordance with the flow chart shown in Chart C. Thus, the grinding cycle includes the positioning of the head assembly 3 to the preset starting position and monitors the setting of the downfeed increment and the spark-out passes, as at 69. The operator then actuates the traverse button as at 70 and the controller oscillates the head assembly until the total downfeed cycle is completed as at 71. In the "auto" mode, the controller then reciprocates the head assembly 3 in the fixed vertical position until the appropriate spark-out counter 55 or 56 has been reset to zero, as shown at 72, and then retracts and stops the head assembly 3. In the manual mode, the head assembly is stopped immediately after the last grinding pass, as at 73.

Assuming the program mode is selected, the program sequences under processor control to monitor actuation of the split selector switch 39*a* and appropriate left and right cycle buttons 46–47. Assuming the left cycle button 46 is actuated, as at 74, the grinding cycle for the left magnetic chuck 14 is processed by actuation of the corresponding chuck 14, as at 66. The program cycle includes step 75 to determine that the right chuck cycle 15 is not being executed. If the right side is being cycled, a suitable signal such as right preset light, not shown, may flash, and the program recycles until such time as the right cycle has been completed. When the controller detects that the right cycle is no longer being executed, the program initiates the left grinding cycle, as at 76. During this execution period, the operator may unload the finished parts from the right chuck 15 and reload rought parts 18 thereon, reprogram the right cycle and the like, as at 77. The operator again presses the right cycle button 47 as at 78, thereby, energizing the magnets of the right magnet chuck 15 and enabling the system for programmed operation of the right cycle. After the left cycle is completed, the controller detects such completion as at 79 and initiates the right grinding cycle in the same sequence as the left grinding cycle, and as at 80, and thus returns to the beginning of the programmed cycle to d-termine if the left cycle button 46 was actuated. Thus, under the program mode, the machine continues to cycle to the right and left stations under the separate enabling controls 46 and 47.

The programmed grinding cycle is similar to that described for the automatic mode. However, in this sequence, the controller includes automatic wear compensation in the creating of the final grinding position. Thus, the controller will include the necessary additional passes to compensate for the wear factor and thereby insure the grinding of the part to the final finished heighth. This may be preset or automatically generated by suitable sensing means, such as sensors 60.

In connection with the various systems and operations, various indicating lights will generally be provided to indicate to the operator the control function and mode then being executed. Such indicating means are not described herein because they can be readily provided by those skilled in the art. Various other control buttons are provided as a part of the normal controls 31 for operating of the system in the semiautomatic or manual operation.

Various modes of carrying out the invention are contemplated as being within the scope of the following claims, particularly pointing out and distinctly claiming the subject matter which is regarded as the invention.

I claim:

1. A grinding machine, comprising an elongated supporting bed and including first and second work stationary holder means for holding of work parts, said holder means being mounted in longitudinal alignment to opposite sides of an intermediate location of the bed and arranged to define a single elongated work support, a grinding head assembly having a carriage means movably mounted to traverse the entire length of both said holder means and having an annular grinding wheel with an end grinding face, sensing means coupled to the head assembly to monitor the movement to the opposite ends of each holder means, vertical sensing means coupled to the head assembly to monitor the vertical position of the grinding wheel, drive means for vertically positioning of said grinding wheel, and logic control means for selectively actuating said head assembly in a mode in which the carriage means alternately and cyclically reciprocates over the first work holder means in a plurality of passes and then over the second work holder means in a plurality of passes in response to enabling the corresponding first and second holder means and having means to reposition said grinding wheel in said successive passes.

2. The grinding machine of claim 1 wherein said logic control means includes means to reposition said grinding wheel to compensate for wheel wear as the result of grinding during one of said cycles.

3. The grinding machine of claim 1 wherein each holder means is an elongated metal flat bed-like member formed of magnetically permeable material and having a plurality of flux generating coils, said holder means being mounted in end-to-end relation whereby simultaneously energizing of such holder means defines an operative single holder unit.

4. The machine of claim 1 wherein said logic control means includes means to selectively operate in a second mode in which the carriage means reciprocates over both holder means in each grinding pass.

5. The grinding apparatus of claim 1 wherein said logic control means includes means defining a final programmed grinding wheel position and means to reposition said grinding wheel in a preselected increment in each pass and includes a final increment limited by said final programmed position of the grinding wheel.

6. The grinding apparatus of claim 1 wherein said logic control includes means preset to establish a series of finishing passes and to then retract the grinding wheel.

7. The grinding apparatus of claim 1 wherein said sensing means includes individual sensor actuators secured to the bed, said grinding head assembly having complementing sensor units operable to generate a control signal in response to alignment of said sensor actuators.

8. The grinding apparatus of claim 1 wherein said sensing means includes signal source connected to the grinding head assembly and source actuators secured to said bed at limits of the head assembly for each of said work holder means.

9. The grinding apparatus of claim 1 wherein said head assembly includes a vertical positioning motor defining said drive means, a position coupler operable to position said grinding wheel, said vertical sensing means including a position transducer coupled to said position coupler and producing an output signal proportional to the vertical position of said wheel, said logic control means including means to read the position transducer and actuate the vertical positioning motor to position the grinding wheel.

10. The grinding machine of claim 1 wherein each work holder means is an elongated metal flat bed-like member formed of magnetically permeable material and having a plurality of flux generating coils, said work holdermeans being mounted in end-to-end relation whereby simultaneously energizing of such work holder means defines an operative single work holder means, and said sensor means includes signal source connected to the grinding head assembly and source actuators secured to said bed at the opposite ends of each bed-like member.

11. A grinding machine, comprising an elongated supporting bed and including first electromagnetic work holder means for holding of work parts to one side of an intermediate portion of the bed and a second electromagnetic work holder means for holding of work parts to the opposite side of said intermediate portion of said bed, each of said work holder means being an elongated platform member and being arranged and constructed to define a continuous single holding means extending between the opposite ends of said first and second work holder means, a grinding head including an annular grinding wheel and a carriage means movably mounted to transverse the work holder means, said carriage means having a home position at the intermediate portion of the bed and thereby at the adjacent ends of the first and second work holder means and being movable over the length of both said holder means, means for vertically positioning of said grinding wheel, and a programmable controller for selectively actuating said carriage means in a mode in which the carriage means alternately and cyclically reciprocates in a plurality of grinding passes over the first work holder means and then the second work holder means in response to enabling the corresponding first and second holder means.

12. The grinding machine of claim 11 wherein said grinding wheel is fed in a series of increments to sequentially remove material from the parts, said programmable control means includes means responsive to the movement of said head assembly to a horizontal limit position in a grinding pass over the part to feed the grinding wheel one feed increment, and including means to produce feed increments which compensate for wear of said grinding wheel.

13. The grinding machine of claim 11 including stop means to terminate execution of the program during a pass of said grinding wheel and moving the head assembly to a limit position.

14. The grinding machine of claim 11 including means to terminate execution of the program at a point within a grinding sequence and to reinitiate execution of the program from the same point in the grinding sequence.

15. An automatic grinding machine having an elongated bed adapted to support work parts in fixed relation for grinding of upper surfaces, comprising a carriage secured to said bed and operable to reciprocate over the length of the bed, a grinding wheel secured to said carriage and having means for high speed rotation of the grinding wheel, the end face of said grinding wheel being operable to grind on the upper surface of said work part, downfeed means for vertically positioning of the grinding wheel, first and second sensor means located one each at the opposite ends of said bed and defining end limits for carriage movements, third and fourth sensor means located intermediate the length of the bed and spaced slightly from each other and the center of the bed, said sensor means defining intermediate limits for controlling movement of the carriage, a vertical position sensor means to monitor the vertical position of said wheel, a controller including a programmable means connected to said sensor means and to said vertical position sensor means and including wear compensation means and operable to actuate said carriage to first reciprocate over the bed between the one end limit sensor and the most closely adjacent intermediate sensor and alternately to reciprocate over the opposite end of the said bed between said corresponding end sensor and the most closely adjacent intermediate sensor, said controller operating said downfeed means to reposition the feed wheel downwardly towards the bed after said wheel passes over the part, said program repositioning the head in accordance with said wear compensation means to further position said grinding wheel downwardly to compensate for wear of the face of said grinding wheel in grinding said part.

* * * * *

UNITED STATES PATENT AND TRADEMARK OFFICE

CERTIFICATE OF CORRECTION

PATENT NO. : 4,499,690

DATED : February 19, 1985

INVENTOR(S) : D. Kilb & R. Diercksmeier

It is certified that error appears in the above-identified patent and that said Letters Patent is hereby corrected as shown below:

Col. 2, line 21, Cancel "grnding" and substitute therefor ---grinding---; Col. 8, line 30, Cancel "therough" and substitute therefor ---through---; Col. 8, line 34, Cancel "heighth" and substitute therefor ---height---; Col. 8, line 51, Cancel "heighth" and substitute therefor ---height---; Col. 8, line 63, Cancel "opeation" and substitute therefor ---operation---; Col. 9, line 22, Cancel "ladder" and substitute therefor ---latter---; Col. 10, line 36, Cancel "rought" and substitute therefor ---rough---; Col. 10, line 45, Cancel "d-termine" and substitute therefor ---determine---; Col. 10, line 56, Cancel "heighth" and substitute therefor ---height---; Claim 11, col. 12, line 29, Cancel "transverse" and substitute therefor ---traverse---

Signed and Sealed this

*Twenty-sixth* Day of *November 1985*

[SEAL]

*Attest:*

DONALD J. QUIGG

*Attesting Officer*

*Commissioner of Patents and Trademarks*